US010247196B2

(12) United States Patent
Lin et al.

(10) Patent No.: US 10,247,196 B2
(45) Date of Patent: Apr. 2, 2019

(54) BLADE MODULE AND FAN USING THE SAME

(71) Applicant: Acer Incorporated, New Taipei (TW)

(72) Inventors: Kuang-Hua Lin, New Taipei (TW); Cheng-Wen Hsieh, New Taipei (TW); Wen-Neng Liao, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 182 days.

(21) Appl. No.: 15/409,728

(22) Filed: Jan. 19, 2017

(65) Prior Publication Data

US 2018/0058467 A1 Mar. 1, 2018

(30) Foreign Application Priority Data

Aug. 25, 2016 (TW) ..... 105212964 U
Nov. 24, 2016 (TW) ..... 105138663 A

(51) Int. Cl.

| | |
|---|---|
| ***F04D 17/16*** | (2006.01) |
| ***F04D 29/28*** | (2006.01) |
| ***F04D 29/30*** | (2006.01) |
| ***F04D 29/62*** | (2006.01) |
| *B21K 1/36* | (2006.01) |

(52) U.S. Cl.

CPC ..... *F04D 29/30* (2013.01); *F04D 17/16* (2013.01); *F04D 29/281* (2013.01); *F04D 29/626* (2013.01); *B21K 1/36* (2013.01); *F05D 2230/54* (2013.01); *F05D 2300/10* (2013.01)

(58) Field of Classification Search

CPC ..... F04D 29/30; F04D 29/421; F04D 17/16; F04D 29/281; F04D 29/626

USPC ..... 416/231

See application file for complete search history.

(56) References Cited

U.S. PATENT DOCUMENTS

| | | | | |
|---|---|---|---|---|
| 1,793,179 | A | 2/1931 | Lanterman et al. | |
| 2,428,728 | A | 10/1947 | Watson | |
| 3,630,636 | A * | 12/1971 | Hill | B01F 7/00466 416/181 |
| 7,713,030 | B2 * | 5/2010 | Tanahashi | F04D 29/30 416/236 R |
| 7,743,955 | B2 * | 6/2010 | Nishikawa | B25C 1/08 123/46 SC |
| 2007/0116576 | A1 * | 5/2007 | Chang | F04D 29/281 416/228 |
| 2009/0311093 | A1 | 12/2009 | Otsuki et al. | |
| 2012/0114512 | A1 * | 5/2012 | Lofy | F04D 29/4226 417/410.1 |

(Continued)

FOREIGN PATENT DOCUMENTS

| | | |
|---|---|---|
| CN | 104033419 A | 9/2014 |
| JP | 2007247495 A | 9/2007 |

OTHER PUBLICATIONS

Taiwan Office Action and Search Report, dated Jul. 4, 2017, 7 pages.

*Primary Examiner* — Dwayne J White
*Assistant Examiner* — Maranatha Boardman
(74) *Attorney, Agent, or Firm* — Edell, Shapiro & Finnan, LLC

(57) ABSTRACT

A blade module and a fan using the same are provided. The blade module includes a rotating shaft and a plurality of blades. Each blade is connected to the rotating shaft and includes a blade body and an airflow guiding portion. The airflow guiding portion is connected to the blade body and has an opening.

9 Claims, 4 Drawing Sheets

(56) References Cited

U.S. PATENT DOCUMENTS

| | | | | |
|---|---|---|---|---|
| 2015/0267715 | A1 | 9/2015 | Lee et al. | |
| 2018/0112676 | A1* | 4/2018 | Yang | B21D 22/02 |

* cited by examiner

BLADE MODULE AND FAN USING THE SAME

This application claims the benefit of Taiwan application Serial No. 105212964, filed Aug. 25, 2016, and claims the benefit of Taiwan application Serial No. 105138663, filed on Nov. 24, 2016, the subject matter of which is incorporated herein by reference.

FIELD OF THE INVENTION

The invention relates to a blade module and a fan using the same, and more particularly to a blade module having an airflow guiding portion and a fan using the same.

BACKGROUND OF THE INVENTION

A computer includes a central processing unit (CPU) for processing a large amount of data. As a result of processing data, the temperature of the CPU rises. To disperse the heat generated by the CPU, the computer is typically equipped with one or more fans. The amount of air flow pushed by the fan represents the heat dissipation performance and capability of the fan. Therefore, manufactures continue to seek methods to increase the air flow output by the fan.

SUMMARY OF THE INVENTION

Embodiments of the present invention provide for an increased amount of air flow for a fan.

In one embodiment of the invention, a blade module is provided. The blade module includes a rotating shaft and a plurality of blades. Each blade connects to the rotating shaft and includes a blade body and a first airflow guiding portion. The blade body has a first edge and a second edge, wherein the first edge and the second edge are arranged in an axial direction of the rotating shaft. The first airflow guiding portion connects to the blade body at a local portion of the first edge.

In another embodiment of the invention, a blade module is made by way of: forming a plurality of blades by using a die stamping forging method and a cutting method, wherein each blade comprises a blade body and a first airflow guiding portion, the blade body has a first edge and a second edge, and the first airflow guiding portion connects to the blade body at a local portion of the first edge; and connecting the blades with a rotating shaft by an insert injection molding method, wherein the first edge and the second edge are arranged in an axial direction of the rotating axis.

In another embodiment of the invention, a fan is provided. The fan includes a casing and a blade module as described above. The casing surrounds a portion of the blade module.

Numerous objects, features and advantages of the invention will be readily apparent upon a reading of the following detailed description of embodiments of the invention when taken in conjunction with the accompanying drawings. However, the drawings employed herein are for the purpose of description and should not be regarded as limiting.

BRIEF DESCRIPTION OF THE DRAWINGS

The above objects and advantages of the invention will become more readily apparent to those ordinarily skilled in the art after reviewing the following detailed description and accompanying drawings, in which.

DETAILED DESCRIPTION OF PREFERRED EMBODIMENTS

Figure 1A:
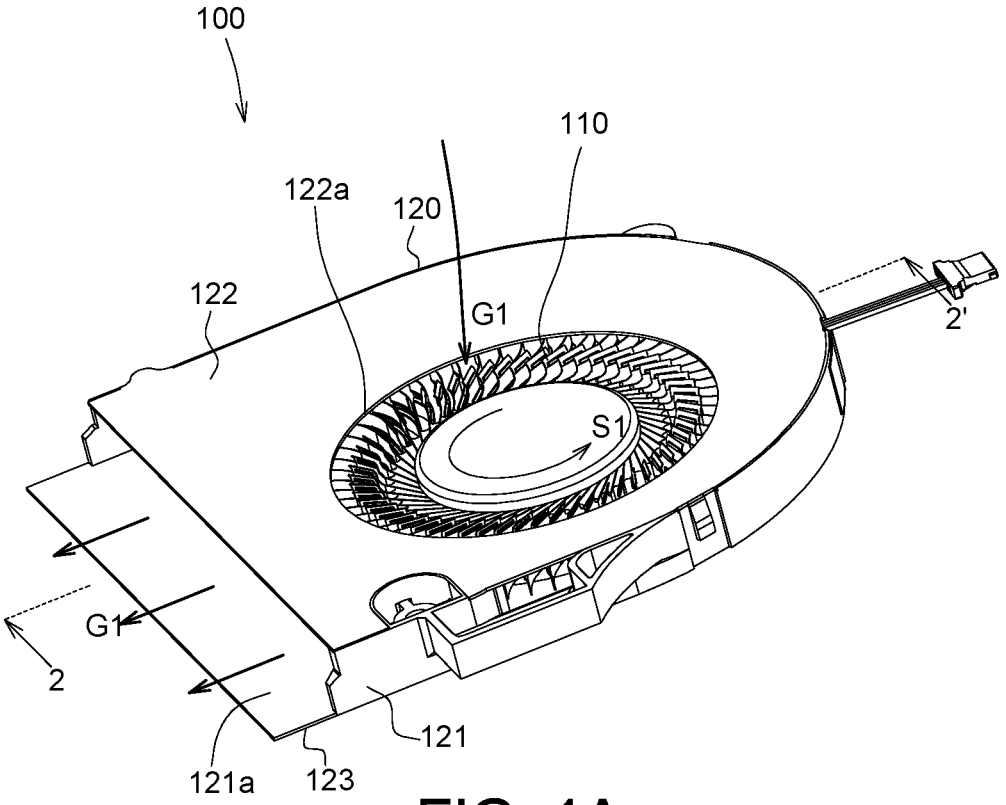
FIG. 1A illustrates a diagram of a fan 100 according to an embodiment of the invention.
Figure 1B:
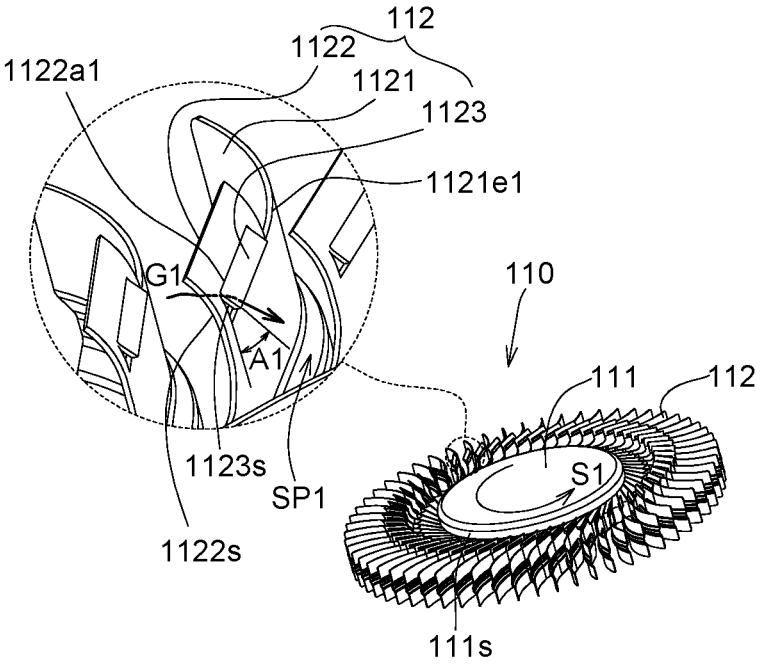
FIG. 1B illustrates a perspective view of the fan 100 of FIG. 1A.
Figure 1C:
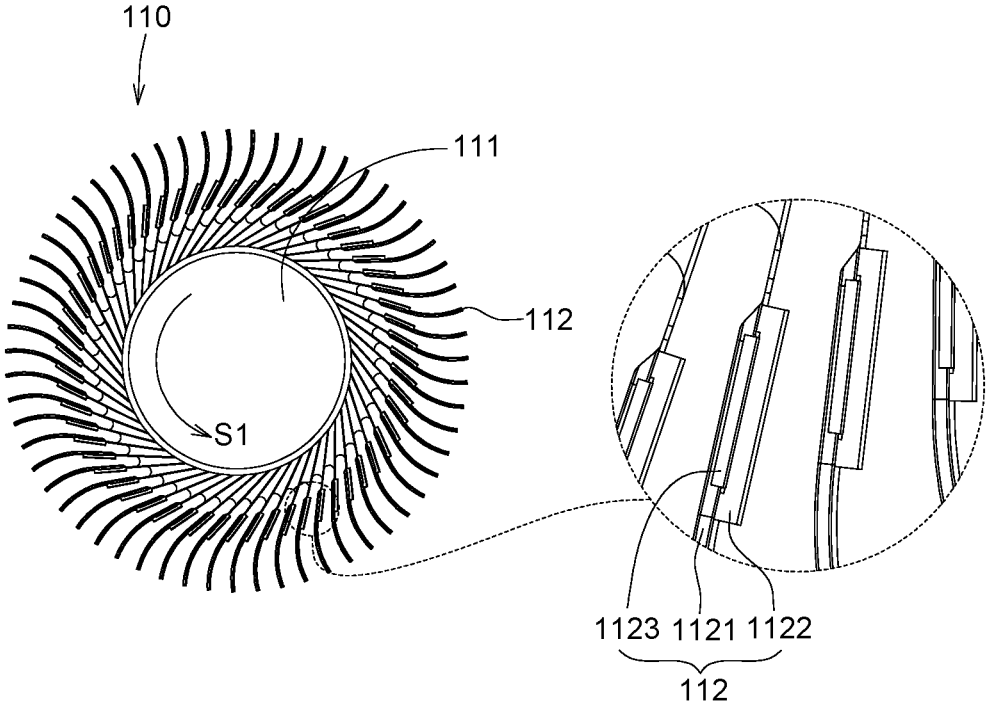
FIG. 1C illustrates a top view of a blade module 110 of FIG. 1B.
Figure 1D:
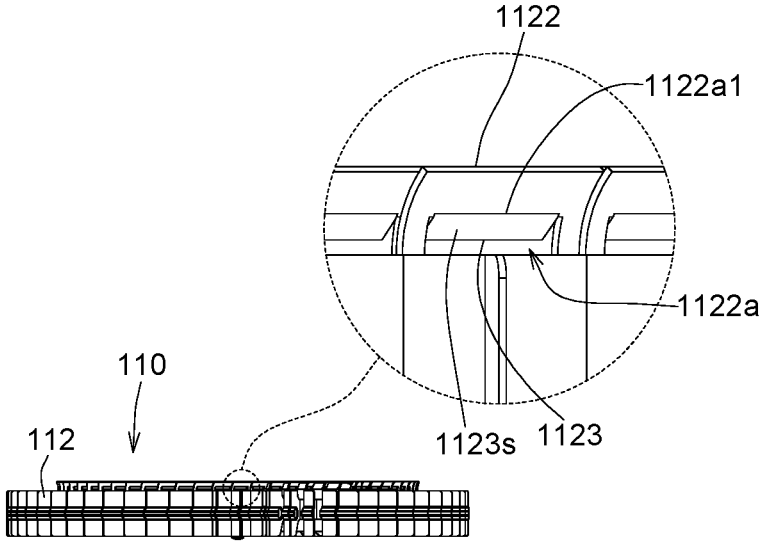
FIG. 1D illustrates a side view of the blade module 110 of FIG. 1B.

Referring to FIGS. 1A to 1D, FIG. 1A illustrates a diagram of a fan 100 according to an embodiment of the invention, FIG. 1B illustrates a perspective view of the fan 100 of FIG. 1A, FIG. 1C illustrates a top view of a blade module 110 of FIG. 1B, and FIG. 1D illustrates a side view of the blade module 110 of FIG. 1B.

The fan 100 of the present embodiment is a centrifugal fan, for example, and it can be applied to a computer or other device which needs heat dissipation, wherein the computer is, for example, a notebook or a desktop computer.

The fan 100 includes a blade module 110 and a casing 120. As shown in FIG. 1A, the casing 120 surrounds a portion of the blade module 110. The casing 120 includes a lateral portion 121, a first shell 122 and a second shell 123, wherein the first shell 122 is located above a blade body 1121, the second shell 123 is located below the blade body 1121, and the lateral portion 121 connects the first shell 122 with the second shell 123. The lateral portion 121 has an airflow outlet 121*a*, and the first shell 122 has an airflow inlet 122*a*. When the blade module 110 operates, an airflow G1 is drawn into the casing 120 via the airflow inlet 122*a* and pushed out of the casing 120 via the airflow outlet 121*a* by the blade module 110.

As shown in FIG. 1B, the blade module 110 includes a rotating shaft 111 and a plurality of blades 112. The rotating shaft 111 has a circumferential surface 111*s*, and each blade 112 is connected to the circumferential surface 111*s* of the rotating shaft 111 and radially extends toward a direction away from the circumferential surface 111*s*. The blade 112 may be a metal blade. More specifically, such metal blades are firstly formed from a sheet metal component by a die stamping forging method and a cutting method. The rotating shaft 111 itself and/or the connections between the rotating shaft 111 and the blades 112 are then formed by another manufacturing process, such as insert injection. The rotating shaft 111 may be made of a material different from that of the blades 112. For example, the rotating shaft 111 may be made of a material including plastic, metal bone frame and/or magnet. The rotating shaft 111 may also be a component of a wheel hub or a motor. Since the blades 112 can be manufactured independently, the thickness of the blade 112 is not limited by the other process. Therefore, the blades 112 can be designed to be thinner.

Compared with a plastic blade, the metal blade of the present invention is thinner, and thus the volume of an airflow pushing region SP1 between two blades 112 may be increased, thereby increasing the amount of the airflow output by the fan 100. In an embodiment, the metal blade 112 may have a thickness less than or substantially equal to 0.2 millimeters, and accordingly such blades can increase the volume of the airflow pushing region SP1 to increase the amount of the airflow output of the fan 100. In an embodiment, the thickness of the metal blade 112 may be as small as 0.1 millimeters or 0.05 millimeters, or even less. In contrast, a plastic blade or conventional blade cannot achieve such size. Since the metal blade 112 has a thin thickness, there can be an increase in the number of the blades 112 to improve the ability of the fan's efficiency. In an embodiment, the number of the blades 112 may be 59 or even more. As the number of the blades increases, so too does the pressure of the airflow output by the fan 100. Compared with the metal blade 112, the number of the plastic blades and the ability of the blades pushing the airflow are limited due to the plastic blade having a thicker thickness.

The airflow pushing region SP1 herein means the space between two blade bodies 1121. The larger the airflow pushing region SP1, the greater the amount of the airflow that is pushed into the airflow pushing region SP1, resulting in a greater amount of airflow output, compared to a fan with comparable (and thicker) plastic blades.

Each blade 112 includes the blade body 1121 and the first airflow guiding portion 1122. The first airflow guiding portion 1122 is connected to the blade body 1121 and has a first opening 1122*a* (the first opening 1122*a* is shown in FIG. 1D). When the blade module 110 operates, the airflow G1 enters the airflow pushing region SP1 between two blades 1121.

As shown in FIG. 1B, each blade 1121 has a first edge 1121*e*1 and a second edge 1121*e*2 (shown in FIG. 3) which are arranged in an axial direction of the rotating shaft 111, that is, the first edge 1121*e*1 and the second edge 1121*e*2 are two opposite edges of the corresponding blade body 1121 in the axial direction of the rotating shaft 111. Each first airflow guiding portion 1122 extends in a direction away from the blade body 1121 at a local portion or a portion of the first edge 1121*e*1 of the corresponding blade body 1121. For example, each first airflow guiding portion 1122 extends toward the axial direction of the rotating shaft 111 and a rotating direction of the rotating shaft 111 simultaneously. As a result, a radial length of the blade 112 is not increased. In other words, the fan 100 of the present embodiment can increase an area of the blade 112 without increasing the radial size of the blade 112.

As shown in FIG. 1B, each first airflow guiding portion 1122 is shaped into a bending shape. For example, each first airflow guiding portion 1122 is inwardly depressed toward a direction reverse to the rotating direction S1 of the rotating shaft 111 to form a windward surface 1122*s*. As a result, when the blade module 110 operates, the airflow G1 can be guided by the windward surface 1122*s* of the first airflow guiding portion 1122 to enter the airflow pushing region SP1 between two blade bodies 1121 through the first opening 1122*a*, and accordingly it can increase the amount of the airflow output of the fan 100. In an embodiment, the windward surface 1122*s* of each first airflow guiding portion 1122 is an arc surface or an inclined plane. The radius of curvature of the windward surface 1122*s* is not limited to the present embodiment. The curvature of one windward surface 1122*s* could be variable or uniform from portion to portion of the windward surface 1122*s*.

As shown in FIG. 1B, each blade body 1121 is inwardly depressed toward a direction reverse to the rotating direction S1 of the rotating shaft 111, and such design may be referred to as a "forward sweep" design. In another embodiment, the blade body 1121 is inwardly depressed toward the rotating direction S1 of the rotating shaft 111, and such design may be referred to as a "backward sweep" design. In either the forward sweep design or the backward sweep design, the first airflow guiding portion 1122 is inwardly depressed toward a direction reverse to the rotating direction S1 of the rotating shaft 111 for guiding the airflow G1 to pass through the first opening 1122*a* and then enter the airflow pushing region SP1 between two blade bodies 1121, thereby increasing the amount of the airflow output by the fan 100.

As shown in FIG. 1B, each blade 112 further includes a second airflow guiding portion 1123. Each second airflow guiding portion 1123 is connected to an opening edge 1122*a*1 of the corresponding first opening 1122*a*, for example, an upper edge. As a result, when the blade module 110 operates, the airflow G1 can be guided by the second airflow guiding portion 1123 to enter the airflow pushing region SP1 between two blade bodies 1121 through the first opening 1122*a* to increase the amount of the airflow output of the fan 100. In addition, the second airflow guiding portion 1123 also has the effect of preventing the airflow G1 from escaping. For example, since the second airflow guiding portion 1123 is connected to the upper edge of the corresponding first opening 1122*a*, the airflow G1 is blocked from escaping upwardly, thereby reducing the loss of the amount of the airflow inlet to the airflow pushing region SP1 between two blade bodies 1121.

The second airflow guiding portion 1123 has a windward surface 1123*s*. In an embodiment, the windward surface 1123*s* of each second airflow guiding portion 1123 is an arc surface or an inclined plane. The radius of curvature of the windward surface 1123*s* is not limited to the embodiment of the present embodiment in that the radius of curvature at different points on the windward surface 1123*s* may be the same or different.

In addition, each second airflow guiding portion 1123 extends toward the airflow pushing region SP1 from the opening edge 1122*a*1. As a result, when the blade module 110 operates, the airflow G1 is guided by the windward surface 1123*s* of the second airflow guiding portion 1123 to concentrate in the airflow pushing region SP1 to increase the amount of the airflow input of the fan 100.

In addition, each second airflow guiding portion 1123 is bent outwardly in a direction reverse to the rotating direction S1 of the rotating shaft 111. As a result, when the blades 112 rotate in the rotating direction S1, the airflow G1 passes the first opening 1122*a* toward a direction reverse to the rotating direction S1 and guided by the windward surface 1123*s* of the second airflow guiding portion 1123 to enter the airflow pushing region SP1 between two blade bodies 1121.

As shown in FIG. 1B, an angle included between the second airflow guiding portion 1123 and the first airflow guiding portion 1121 connected to the second airflow guiding portion 1123 ranges between 0 degree and 90 degrees for increasing the amount of the airflow input to the airflow pushing region SP1.

Figure 2:
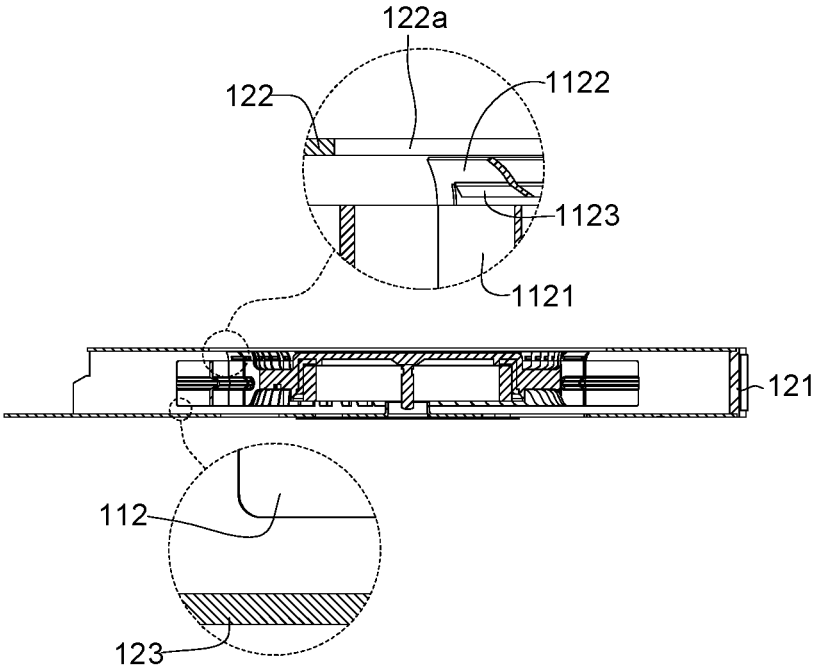
FIG. 2 illustrates a cross-sectional view of the fan 100 of FIG. 1A along direction 2-2'.

FIG. 2 illustrates a cross-sectional view of the fan 100 of FIG. 1A along direction 2-2'. Each first airflow guiding portion 1122 may be entirely exposed from the airflow inlet 122*a* and the first airflow guiding portion 1122 does not project upwardly from an upper surface of the first shell 122. As a result, when the blade module 110 operates, the first shell 122 or other neighboring device does not interfere with the first airflow guiding portion 1122. In another embodiment, in the case of a pre-designed appearance and a spatial arrangement of adjacent devices, each first airflow guiding portion 1122 also can project from the upper surface of the first shell 122. That is, the first airflow guiding portion 1122 also can pass through and be located at the airflow inlet 122*a*. In another embodiment, the first shell 122 may cover at least a portion of each first airflow guiding portion 1122. Under such a design, the first shell 122 is spaced from each first airflow guiding portion 1122 by a distance, such that when the blade module 110 operates, the first shell 122 is prevented from interfering with each first airflow guiding portion 1122. In addition, the second shell 123 is spaced from each blade body 1121 by a distance. When the blade module 110 operates, the second shell 123 is prevented from interfering with each blade body 1121.

Figure 3:
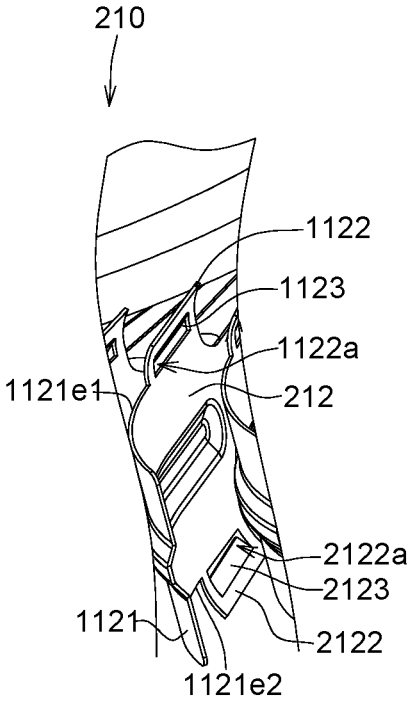
FIG. 3 illustrates a diagram of a blade module 210 according to another embodiment of the invention.

FIG. 3 illustrates a diagram of a blade module 210 according to another embodiment of the invention. The blade module 210 includes the rotating shaft 111 (not illustrated) and a plurality of blades 212. Each blade 212 includes the blade body 1121, the first airflow guiding portion 1122, the second airflow guiding portion 1123, a third airflow guiding portion 2122 and a fourth airflow guiding portion 2123. The blade body 1121 of each blade 212 has the first edge 1121*e*1 and the second edge 1121*e*2 opposite to the first edge 1121*e*1, each first airflow guiding portion 1122 connects the first edge 1121*e*1 of the corresponding blade body 1121, and each third airflow guiding portion 2122 connects the second edge 1121*e*2 of the corresponding blade body 1121. The third airflow guiding portion 2122 has a second opening 2122*a* for enabling the technical effect of the aforementioned first opening 1122*a*. In addition, the connection relationship between the fourth airflow guiding portion 2123 and the third airflow guiding portion 2122 is similar to that of the second airflow guiding portion 1123 and the first airflow guiding portion 1122.

Figure 4:
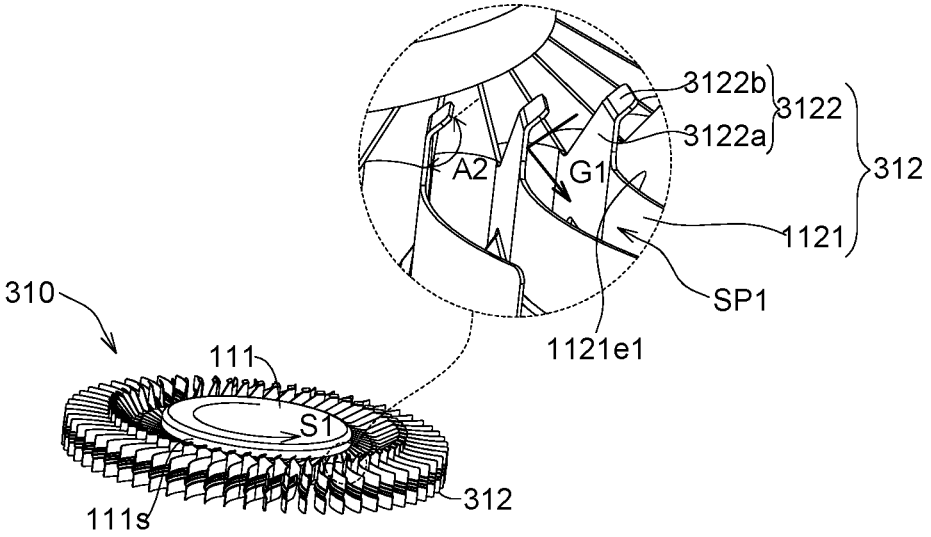
FIG. 4 illustrates a perspective view of a blade module 310 according to another embodiment of the invention.

FIG. 4 illustrates a perspective view of a blade module 310 according to another embodiment of the invention. The blade module 310 includes the rotating shaft 111 and a plurality of blades 312. The rotating shaft 111 has the circumferential surface 111*s*. Each blade 312 is connected to the circumferential surface 111*s* of the rotating shaft 111 and radially extends toward a direction away from the circumferential surface 111*s*.

Each blade 312 includes the blade body 1121 and a first airflow guiding portion 3122, wherein the first airflow guiding portion 3122 is connected to the blade body 1121. Each first airflow guiding portion 3122 includes a first extending portion 3122*a* and a second extending portion 3122*b* connected to the first extending portion 3122*a*, wherein the first extending portion 3122*a* is connected to a local portion of the first edge 1121*e*1 of the corresponding blade body 1121, and extends toward a direction away from the first edge 1121*e*1 from the first edge 1121*e*1 in the rotating direction S1 of the rotating shaft 111. Each second extending portion 3122*b* extends toward a direction away from a side of the blade body 1121 from the first extending portion 3122*a*, and extends toward the rotating direction S1 of the rotating shaft 111 simultaneously. More particularly, the first extending portion 3122*a* and the second extending portion 3122*b* have an obtuse angle A2, which is located at a downstream side of the first extending portion and the second extending portion along the rotating direction S1 of the rotating shaft. It should be noted that the obtuse angle mentioned represents an angle larger than 90 degrees and smaller than 180 degrees. When the blades 312 rotate in the rotating direction S1, the airflow G1 is pushed by the first airflow guiding portion 3122, and is pushed to enter the airflow pushing region SP1 by the first extending portion 3122*a* and the second extending portion 3122*b*, such that the airflow smoothly enters the airflow pushing region SP1, thereby increasing the amount of airflow output by the fan 100.

In another embodiment of the present invention, the aforementioned first airflow guiding portion may be shaped into a smooth curved-surface shape, and does not have an obvious boundary or a bend line between the first extending portion and the second extending portion.

In addition, the material and/or size of the blade 312 may be similar to that of the aforementioned blade 112. The manufacturing method of the blade 312 and the rotating shaft 111 of the present embodiment may be similar to that of the aforementioned blade 112 and the rotating shaft 111. In another embodiment, the first airflow guiding portion 3122 may extend downwardly from the second edge 1121*e*2, or two first airflow guiding portions 3122 may extend from the first edge 1121*e*1 and the second edge 1121*e*2 respectively.

Figure 5:
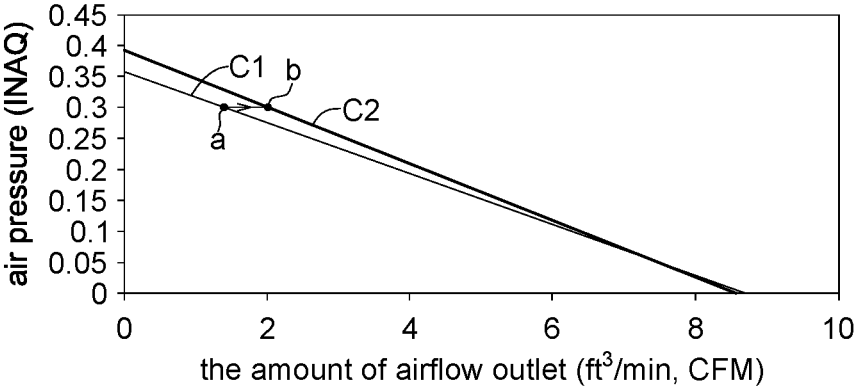
FIG. 5 illustrates a relationship of the amount of airflow output and air pressure.

A relationship of the amount of airflow output and air pressure is recorded in FIG. 5. Data was obtained via testing. In the figure, the horizontal axis represents the amount of the airflow outputted by the fan, and the vertical axis represents the air pressure of the fan. In the case of the structural geometry size and other conditions being the same, the curve C1 represents a blade module without the aforementioned airflow guiding portion of each embodiment, and the curve C2 represents a fan deploying the blade module 310 of FIG. 4. As shown in the figure, when the amount of the airflow output is zero (for example, the airflow outlet 121*a* is closed), the air pressure is maximum. When the amount of the airflow output is not equal to zero, compared with the curve C1, the amount of the airflow output (the curve C2) of the fan deploying the blade module 310 is obviously increased, which means that heat dissipation performance is improved. In the case of constant air pressure, the more the amount of the airflow output of the fan is, the better the fluidity of the airflow output within the electronic device and the heat dissipation performance are. In the example of the air pressure being 0.3, compared with the curve C1, the amount of the airflow output of the fan deploying the blade module 310 is increased by 30% (for example, from point a to point b).

As described above, the blade module of an embodiment of the present invention includes several blades, wherein each blade includes a blade body and a first airflow guiding portion, and the first airflow guiding portion connects with a first edge of the blade body. Each first airflow guiding portion has a first opening, the airflow can enter the region between two blade bodies through the first opening for increasing the amount of the airflow outlet by the fan. In an embodiment, each blade further includes a second airflow guiding portion connecting to an opening edge of the first opening for increasing the effect on the guiding for the airflow and making more airflow enter the region between two blade bodies. In another embodiment, each blade may further include a third airflow guiding portion and a fourth airflow guiding portion, wherein the third airflow guiding portion connects to a second edge of the blade body for increasing the amount of airflow outlet by the fan. In another embodiment, the first airflow guiding portion includes a first extending portion and a second extending portion connecting to the first extending portion. The first extending portion is substantially vertical to the first edge of the corresponding blade body, and the second airflow guiding portion extends toward the rotating direction of the rotating shaft. As a result, when the blades rotate in the rotating direction, the airflow is pushed by the first airflow guiding portion to increase the amount of airflow outlet by the fan. In another embodiment, an obtuse angle is included between the first extending portion and the second extending portion; as a result, when the blade module rotates in the rotating direction, the airflow is pushed into the airflow pushing region by the first extending portion and the second extending portion for increasing the amount of airflow outlet by the fan.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A blade module, comprising:

a rotating shaft; and a plurality of blades each connecting to the rotating shaft and comprising:

a blade body having a first edge and a second edge, wherein the first edge and the second edge are arranged in an axial direction of the rotating shaft; and a first airflow guiding portion connecting to the blade body at a local portion of the first edge, wherein each first airflow guiding portion has an enclosed first opening, and each enclosed first opening has a second airflow guiding portion connected to an opening edge of the enclosed first opening.

2. The blade module as claimed in claim 1, wherein an airflow pushing region is formed between two adjacent blade bodies, and each second airflow guiding portion extends toward the corresponding airflow pushing region.

3. The blade module as claimed in claim 1, wherein each second airflow guiding portion is bent outwardly in a direction opposite to a rotating direction of the rotating shaft.

4. The blade module as claimed in claim 1, wherein an angle included between the first airflow guiding portion and the second airflow guiding portion connected to the first airflow guiding portion ranges between 0 degree and 90 degrees.

5. The blade module as claimed in claim 1, wherein each first airflow guiding portion extends from the local portion of the first edge of the corresponding blade body toward a direction away from the corresponding blade body.

6. The blade module as claimed in claim 1, wherein each first airflow guiding portion is shaped into a bending shape which is inwardly depressed toward a direction reverse to a rotating direction of the rotating shaft.

7. The blade module as claimed in claim 1, wherein each blade further comprises:

a third airflow guiding portion connecting to the second edge of the corresponding blade body and having a second opening.

8. The blade module as claimed in claim 1, wherein each blade is a metal blade and has a thickness substantially equal to or less than 0.1 millimeters.

9. A fan, comprising:

a blade module comprising:

a rotating shaft; and a plurality of blades each connecting to the rotating shaft and comprising:

a blade body having a first edge and a second edge, wherein the first edge and the second edge are arranged in an axial direction of the rotating shaft; and a first airflow guiding portion connecting to the blade body at a local portion of the first edge, wherein the first airflow guiding portion has an enclosed first opening and the enclosed first opening has a second airflow guiding portion connected to an opening edge of the enclosed first opening; and a casing surrounding a portion of the blade module and separated from each first airflow guiding portion by a distance.

* * * * *